US009510102B2

(12) United States Patent
Zheng et al.

(10) Patent No.: US 9,510,102 B2
(45) Date of Patent: Nov. 29, 2016

(54) MOVING IRON SOUNDING DEVICE

(71) Applicant: Transound Electronics Co., Ltd., Dongguan (CN)

(72) Inventors: Huming Zheng, Dongguan (CN); Zhijian He, Dongguan (CN); Yu Zhang, Dongguan (CN); Xiaolin Deng, Dongguan (CN); Tseng-feng Wen, Dongguan (CN)

(73) Assignee: TRANSOUND ELECTRONICS CO., LTD., Dongguan, Guangdong (CN)

( * ) Notice: Subject to any disclaimer, the term of this patent is extended or adjusted under 35 U.S.C. 154(b) by 0 days.

(21) Appl. No.: 14/840,056

(22) Filed: Aug. 31, 2015

(65) Prior Publication Data

US 2016/0165352 A1 Jun. 9, 2016

(30) Foreign Application Priority Data

Dec. 3, 2014 (CN) ..... 2014 2 0744264 U
Dec. 3, 2014 (CN) ..... 2014 2 0745492 U

(51) Int. Cl.
*H04R 25/00* (2006.01)
*H04R 9/02* (2006.01)
*H04R 7/16* (2006.01)

(52) U.S. Cl.
CPC ..... *H04R 9/025* (2013.01); *H04R 7/16* (2013.01)

(58) Field of Classification Search
CPC ..... H04R 11/00; H04R 7/16; H04R 9/025
USPC ..... 381/412, 411, 409, 410, 414
See application file for complete search history.

(56) References Cited

FOREIGN PATENT DOCUMENTS

CN 203399283 U * 1/2014

* cited by examiner

*Primary Examiner* — Sunita Joshi
(74) *Attorney, Agent, or Firm* — Leong C. Lei

(57) ABSTRACT

A moving iron sounding device includes a casing, a diaphragm sounding system, and a magnetic circuit system. The magnetic circuit system includes a dual-rectangle-shaped magnetic circuit, an inductance coil, and an armature. The diaphragm sounding system includes a support ring and a composite diaphragm. The composite diaphragm includes a diaphragm sheet and a metal sheet. One end of the metal sheet is welded to the vibration portion through a connecting arm, and another end of the metal sheet is connected to the support ring. The present invention achieves a stable connection of the diaphragm sounding system and the magnetic circuit system and ensures the quality of the product. During the process of assembly, the adhesive won't be spilled on the diaphragm.

5 Claims, 8 Drawing Sheets

MOVING IRON SOUNDING DEVICE

BACKGROUND OF THE INVENTION

1. Field of the Invention

The present invention relates to a sounding device used for speakers, loudspeakers, headphones, and the like, and more particularly, to a moving iron sounding device.

2. Description of the Prior Art

A moving iron sounding device is widely used to speakers, loudspeakers, headphones, and the like. The moving iron sounding device comprises a casing, a diaphragm sounding system, and a magnetic circuit system. The diaphragm sounding system comprises a vibration plate, a resin diaphragm, and a retaining frame. When assembled, the vibration plate is adhered to the bottom of the resin diaphragm, and then the circumferential edge of the resin diaphragm is adhered to the upper surface of the retaining frame to cover the opening of the retaining frame. Because there is a gap between the vibration plate and the inner wall surface of the opening of the retaining frame, the gap is filled with the adhesive for connecting the vibration plate with the retaining frame. When the vibration plate and the resin diaphragm are adhered to the retaining frame, it is not easy to get a precise alignment. When the gap is filled with the adhesive, the adhesive may spill on the reign diaphragm. These factors may impact the quality of the products.

In general, the diaphragm sounding system and the magnetic circuit system are connected by a guide wire. When assembled, one end of the guide wire is welded to a free end of an elastic plate of the magnetic circuit system, and another end of the guide wire is welded or adhered to the diaphragm of the diaphragm sounding system. The assembly is troublesome, and the production efficiency is lower. The connecting joints of the two ends of the guide wire may loosen to influence the functions of the products.

Accordingly, the inventor of the present invention has devoted himself based on his many years of practical experiences to solve this problem.

SUMMARY OF THE INVENTION

The primary object of the present invention is to provide a moving iron sounding device. It is easy to achieve a stable connection of a diaphragm sounding system and a magnetic circuit system, and it is convenient to align a composite diaphragm with a support ring so as to be bound together. The adhesive won't be spilled on the diaphragm so as to ensure the quality of the products.

In order to achieve the aforesaid object, the moving iron sounding device of the present invention comprises a casing, a diaphragm sounding system, and a magnetic circuit system. The diaphragm sounding system and the magnetic circuit system are located in the casing. The magnetic circuit system comprises a dual-rectangle-shaped magnetic circuit, an inductance coil, and an armature. The armature has a vibration portion. The vibration portion passes through the inductance coil. A free end of the vibration portion is suspended in the dual-rectangle-shaped magnetic circuit. The diaphragm sounding system includes a support ring and a composite diaphragm. The support ring has an opening. The composite diaphragm is disposed on top of the support ring to cover the opening of the support ring. The composite diaphragm includes a diaphragm sheet and a metal sheet which are composited to become one-piece. A first end of the metal sheet is connected with the vibration portion. An interval is defined between the first end of the metal sheet and an inner wall surface of the opening of the support ring. A second end of the metal sheet is directly attached to the support ring. The metal sheet is connected with a connecting arm. A distal end of the connecting arm is provided with a welding portion. The welding portion is welded to the free end of the vibration portion.

The beneficial effect of the present invention is to improve the structure of the diaphragm sounding system. The end of the metal sheet is directly attached to the support ring, such that it is convenient to align the composite diaphragm with the support ring so as to be bound together. This solves the problem of the prior art. The adhesive won't be spilled on the diaphragm to ensure the quality of the products. The metal sheet is bent to extend and form a connecting arm. The connecting arm is connected between the diaphragm sounding system and the magnetic circuit system by welding. It is not hard to process the connection, and the connection is stable. During transportation and use, the connecting joint won't loosen so as to ensure the stability of the products.

DETAILED DESCRIPTION OF THE PREFERRED EMBODIMENTS

Figure 1:
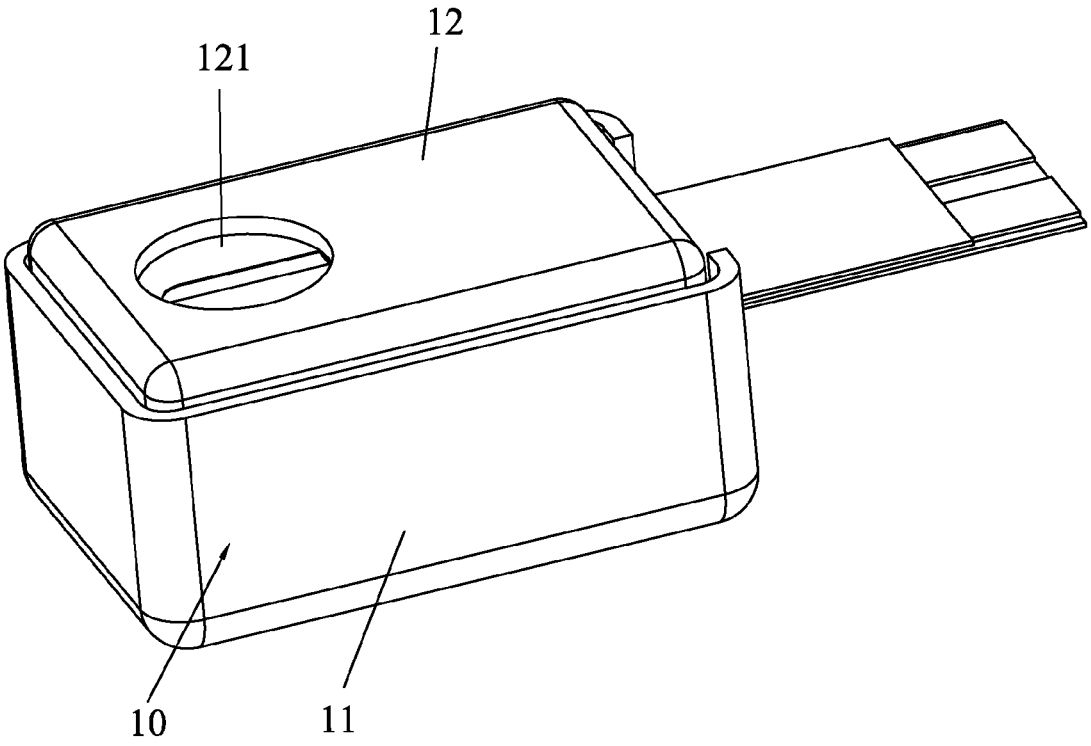
FIG. 1 is a perspective view according to a first embodiment of the present invention.

Embodiments of the present invention will now be described, by way of example only, with reference to the accompanying drawings.

As shown in FIG. 1 through FIG. 10, the present invention discloses a moving iron sounding device. The moving iron sounding device comprises a casing 10, a diaphragm sounding system 20, and a magnetic circuit system 30. The diaphragm sounding system 20 and the magnetic circuit system 30 are located in the casing 10.

FIG. 1 through FIG. 7 shows a first embodiment of the present invention. The casing 10 includes a main body 11 and a cover 12. The main body 11 comprises a base and a side wall integrally connected to the base. The cover 12 is configured to cover an opening at the upper end of the main body 11. The diaphragm sounding system 20 and the magnetic circuit system 30 are located in the main body 11. The diaphragm sounding system 20 is located above the magnetic circuit system 30.

Figure 2:
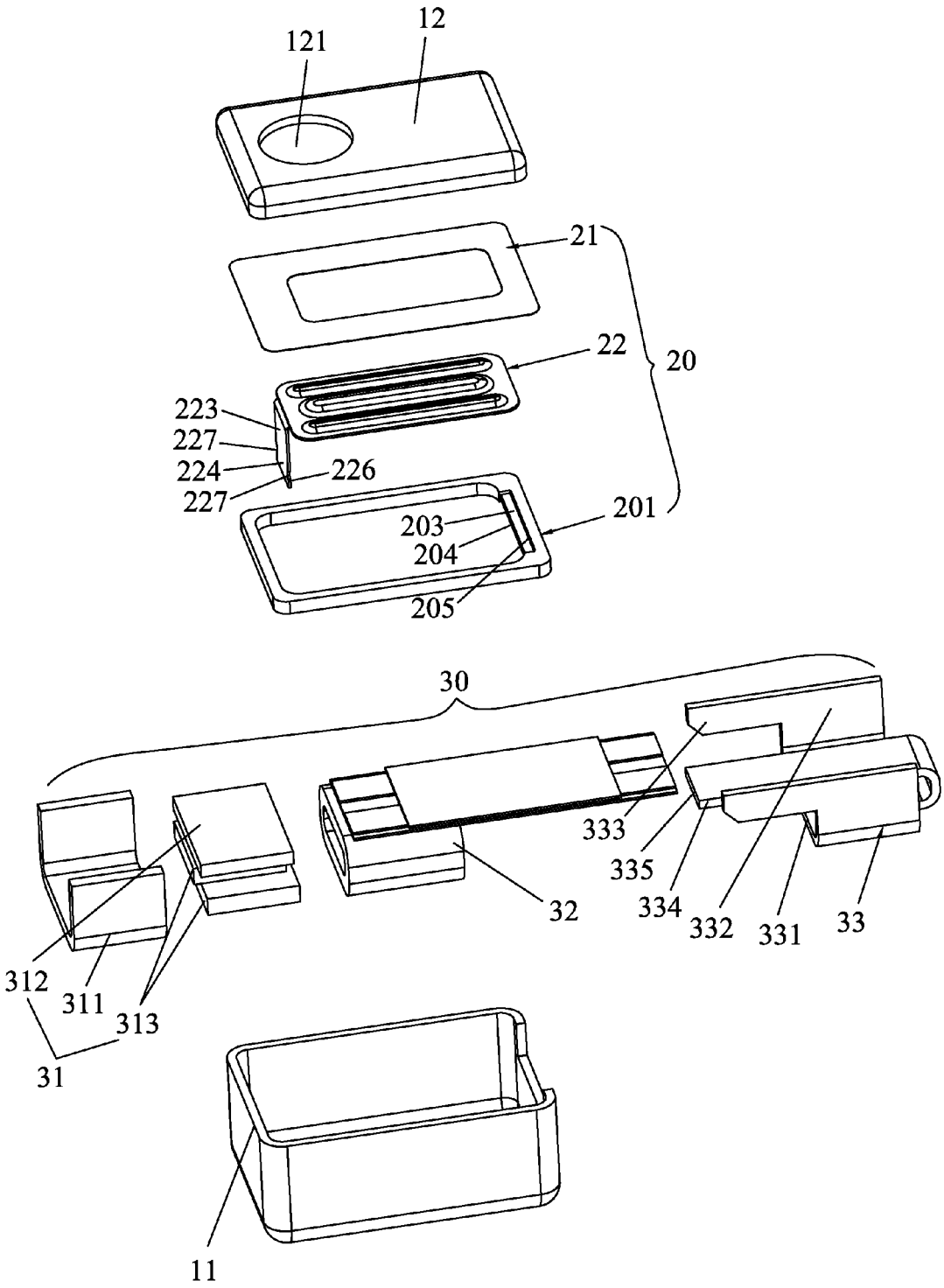
FIG. 2 is an exploded view according to the first embodiment of the present invention.
Figure 3:
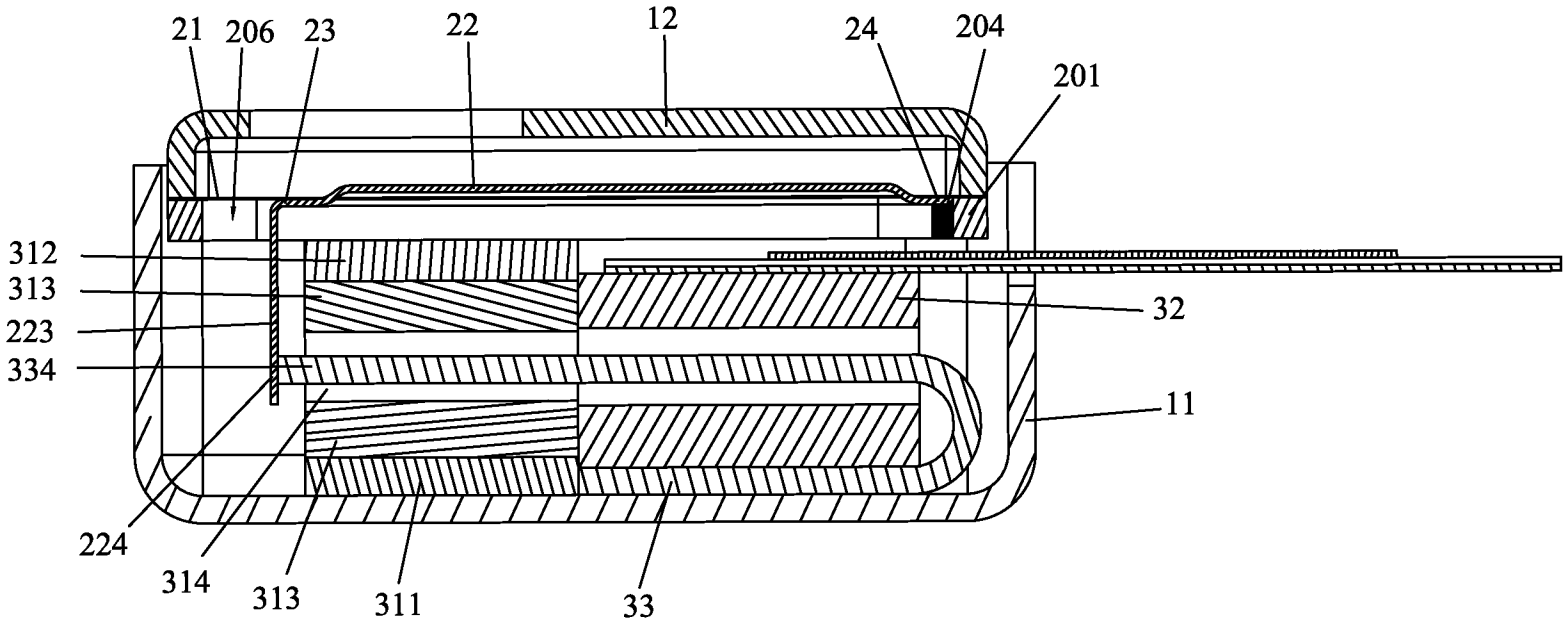
FIG. 3 is a sectional view according to the first embodiment of the present invention.

The diaphragm sounding system 20 includes a support ring 201 and a composite diaphragm 202. The support ring 201 has an opening. The composite diaphragm 202 is disposed on top of the support ring 201 to cover the opening of the support ring 201. The composite diaphragm 202 includes a diaphragm sheet 21 a metal sheet 22 which are composited to become one-piece. A first end 23 of the metal sheet 22 is bent downward to extend and form a connecting arm 223. The connecting arm 223 is connected with a vibration portion 334 of the magnetic circuit system 30. In an embodiment, the connecting arm and the metal sheet can be designed to be separate. An interval 206 is defined between the first end 23 of the metal sheet 22 and an inner wall surface of the opening of the support ring 201. A second end 24 of the metal sheet 22 is directly attached to the support ring 201. In this embodiment, a distal end face of the second end 24 of the metal sheet 22 is attached to the inner wall surface of the support ring 201. An upper surface of the second end 24 is flush with an upper surface of the support ring 201. As shown in FIG. 2 and FIG. 3, the inner wall surface of the support ring 201 is further formed with a cavity 203 for accommodating adhesive. The cavity 203 penetrates the upper and lower surfaces of the support ring 201. The distal end face of the second end 24 of the metal sheet 22 is attached to the inner wall surface of the cavity 203. An inner bottom portion of the cavity 203 is provided with adhesive 204. The adhesive 204 is disposed between the bottom face of the metal sheet 22 and the inner wall surface of the cavity 203. A circumferential edge of the diaphragm sheet 21 extends out of the second end 24 of the metal sheet 22 to be attached to the upper surface of the support ring 201, as shown in FIG. 3.

Figure 4:
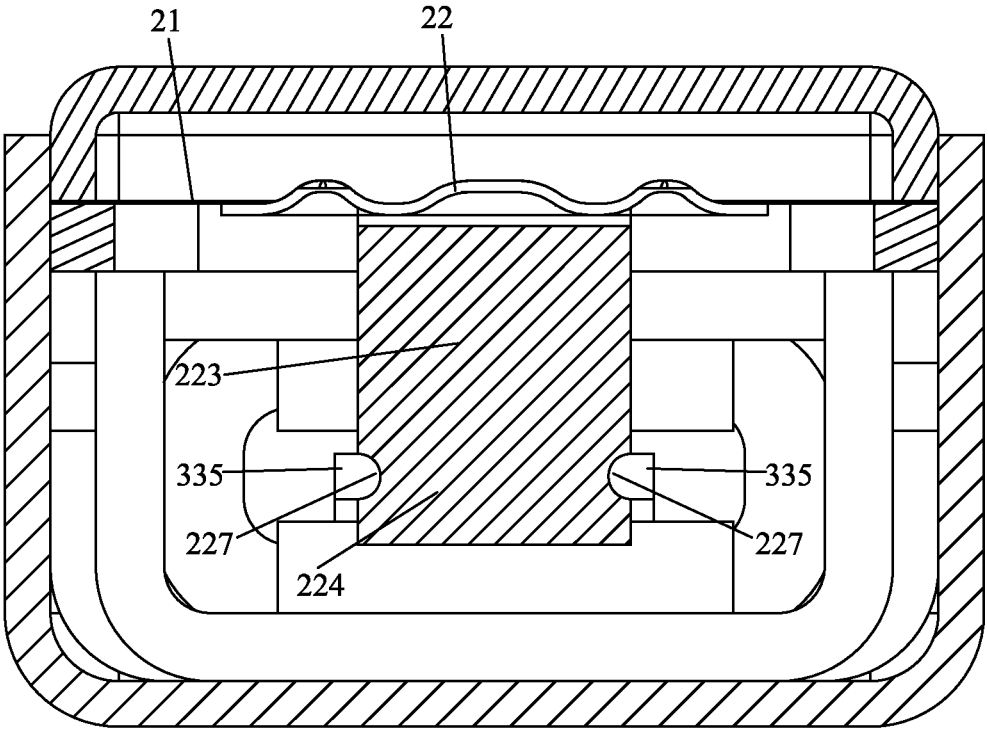
FIG. 4 is another sectional view according to the first embodiment of the present invention.
Figure 5:
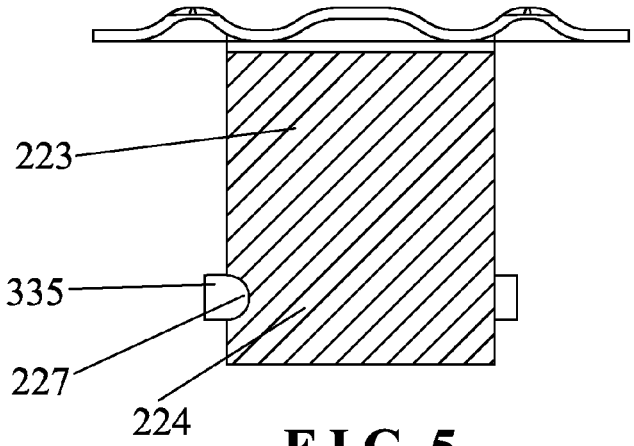
FIG. 5 to FIG. 7 shows another three embodiments of the welding portion of FIG. 3.
Figure 6:
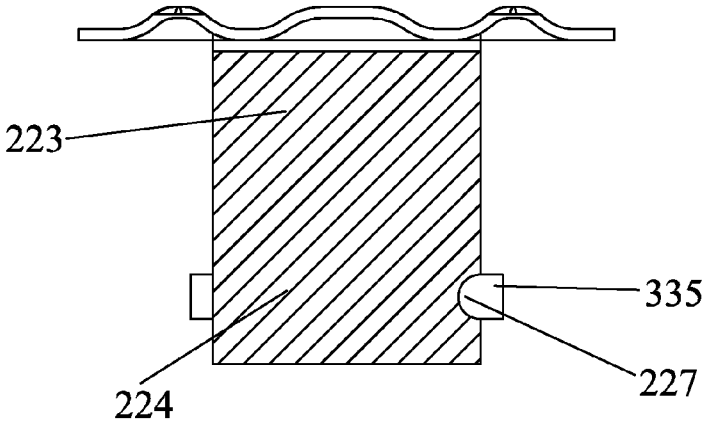
Figure 7:
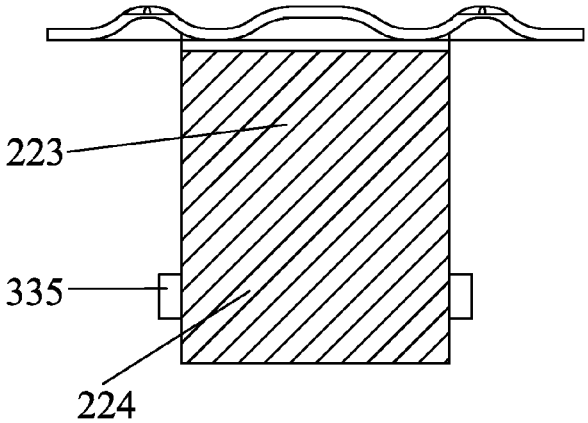

As shown in FIG. 4, a welding portion 224 has a first welding face 227. An end face of a free end of the vibration portion 334 is defined as a second welding face 335. The first welding face 227 is attached to the second welding face 335. As shown in FIG. 7, the welding portion 224 can be directly welded to the second welding face 335. As shown in FIG. 4 through FIG. 6, the welding portion 224 can be formed with a through groove 228 for welding. The through groove 228 penetrates the first welding face 227 to another opposing face of the welding portion 224. The second welding face 335 is exposed corresponding to the through groove 228. The through groove 228 is located at one side or two sides of the welding portion 224. In this embodiment, the through groove 228 is formed with an opening at the side of the welding portion 224 to penetrate an outside thereof. The second welding face 335 extends toward the outside of the opening and extends out of the opposing face of the welding portion 224. This configuration is beneficial for welding operation and ensures the stability of welding.

The magnetic circuit system 30 comprises a dual-rectangle-shaped magnetic circuit 31, an inductance coil 32, and an armature 33. The armature 33 includes a substrate 331, two retaining walls 333, and a vibration portion 334. The vibration portion 334 extends right from a right end of the substrate 331 and then is bent reversely. The free end of the vibration portion 334 extends left. Two sides of the substrate 331 are formed with side walls 332 extending upward, respectively. Left ends of the side walls 332 extend left to form the retaining walls 333, respectively. The dual-rectangle-shaped magnetic circuit 31 is located between the two retaining walls 333. The dual-rectangle-shaped magnetic circuit 31 includes a U-shaped iron piece 311, an I-shaped iron piece 312, and two magnets 313. The I-shaped iron piece 312 is welded to an opening of an upper end of the U-shaped iron piece 312 to form a dual-rectangle-shaped configuration. The two magnets 313 are installed on the U-shaped iron piece 311 and the I-shaped iron piece 312, respectively. The vibration portion 334 passes through the inductance coil 32, and the free end of the vibration portion 334 is suspended in the dual-rectangle-shaped magnetic circuit 31.

The working principle of the moving iron sounding device is described hereinafter. The alternating current signal is transmitted to the inductance coil 32. The magnetic field generated by the inductance coil 32 is conducted to the vibration portion 334, enabling the vibration portion 334 to generate magnetic polarization. Along with the change of the magnetic pole and the change of the intensity of the vibration portion 334, the vibration portion 334 subject to the magnetic force vibrates in the space 314 defined between the two magnets 313. The vibrational frequency is directly transmitted to the composite diaphragm 202. By the diaphragm sheet 21, the surrounding air is agitated to transmit the sound out through a sound output hole 121.

Figure 8:
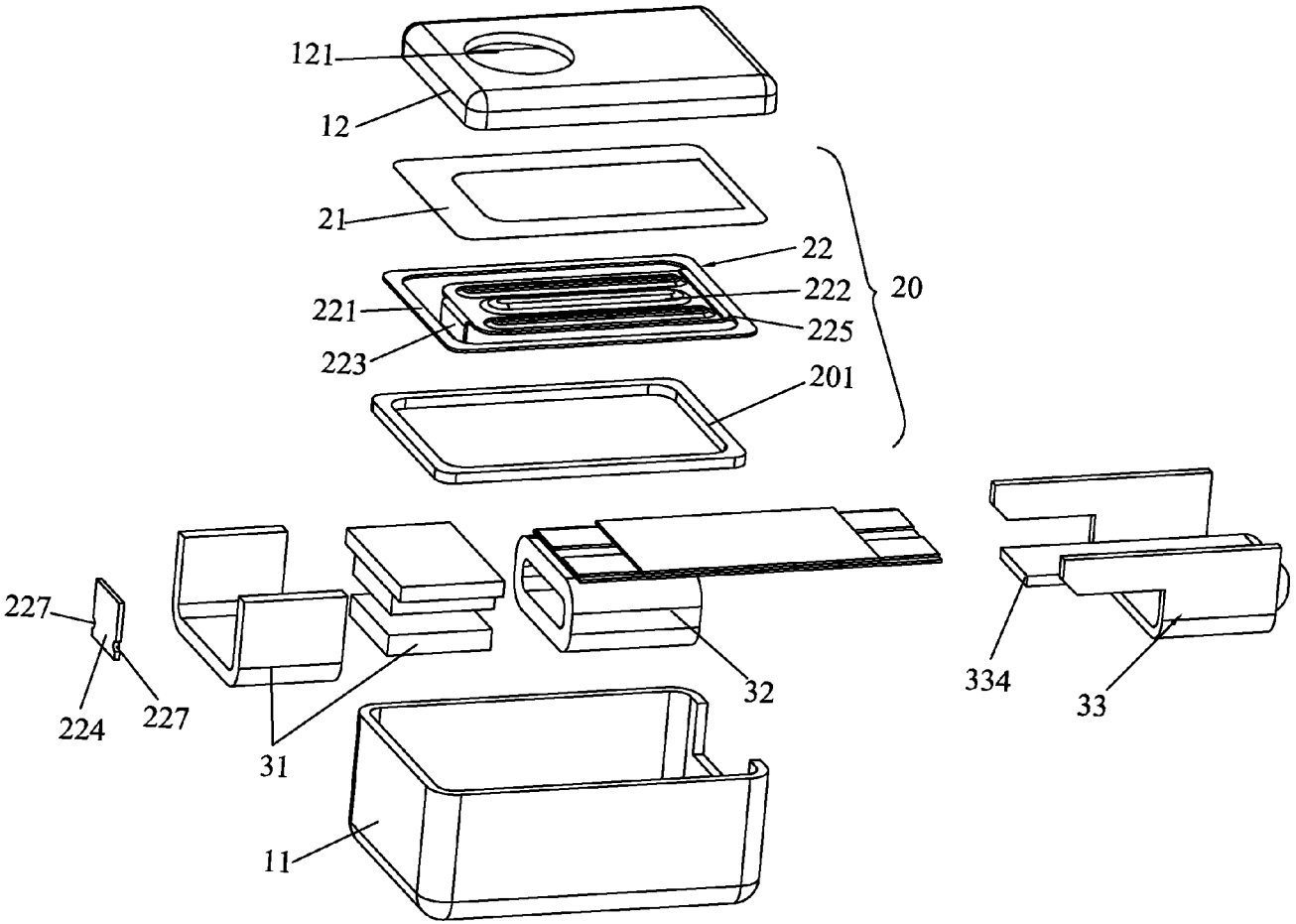
FIG. 8 is an exploded view according to a second embodiment of the present invention.

FIG. 8 shows a second embodiment of the present invention. The second embodiment is substantially similar to the first embodiment with the exceptions described hereinafter. The design of the connecting arm is different from that of the first embodiment. The lower end of the connecting arm is further connected with an extension arm. The extension arm and the connecting arm are disposed separately. The welding portion 224 is disposed on the extension arm.

As shown in FIG. 8, the distal end face the second end 24 of the metal sheet 22 is flush with the corresponding end face of the diaphragm sheet 21. The second end 24 of the metal sheet 22 is directly attached to the upper end face of the support ring 201. As shown in FIG. 8, the metal sheet 22 comprises a dual-rectangle-shaped frame portion 221 and a vibration arm portion 222 suspended in the dual-rectangle-shaped frame portion 221. One end of the dual-rectangle-shaped frame portion 221 is integrally formed with an inner wall surface of the dual-rectangle-shaped frame portion 221. A raised arc portion 225 is integrally formed between the vibration arm portion 222 and the dual-rectangle-shaped frame portion 221. Another end of the vibration arm portion 222 is suspended and connected with the vibration portion 334. The diaphragm sheet 21 corresponds in shape to the dual-rectangle-shaped frame portion 221. The diaphragm sheet 21 is adhered to the dual-rectangle-shaped frame portion 221. The arc portion 225 is exposed out of the diaphragm sheet 21.

Figure 9:
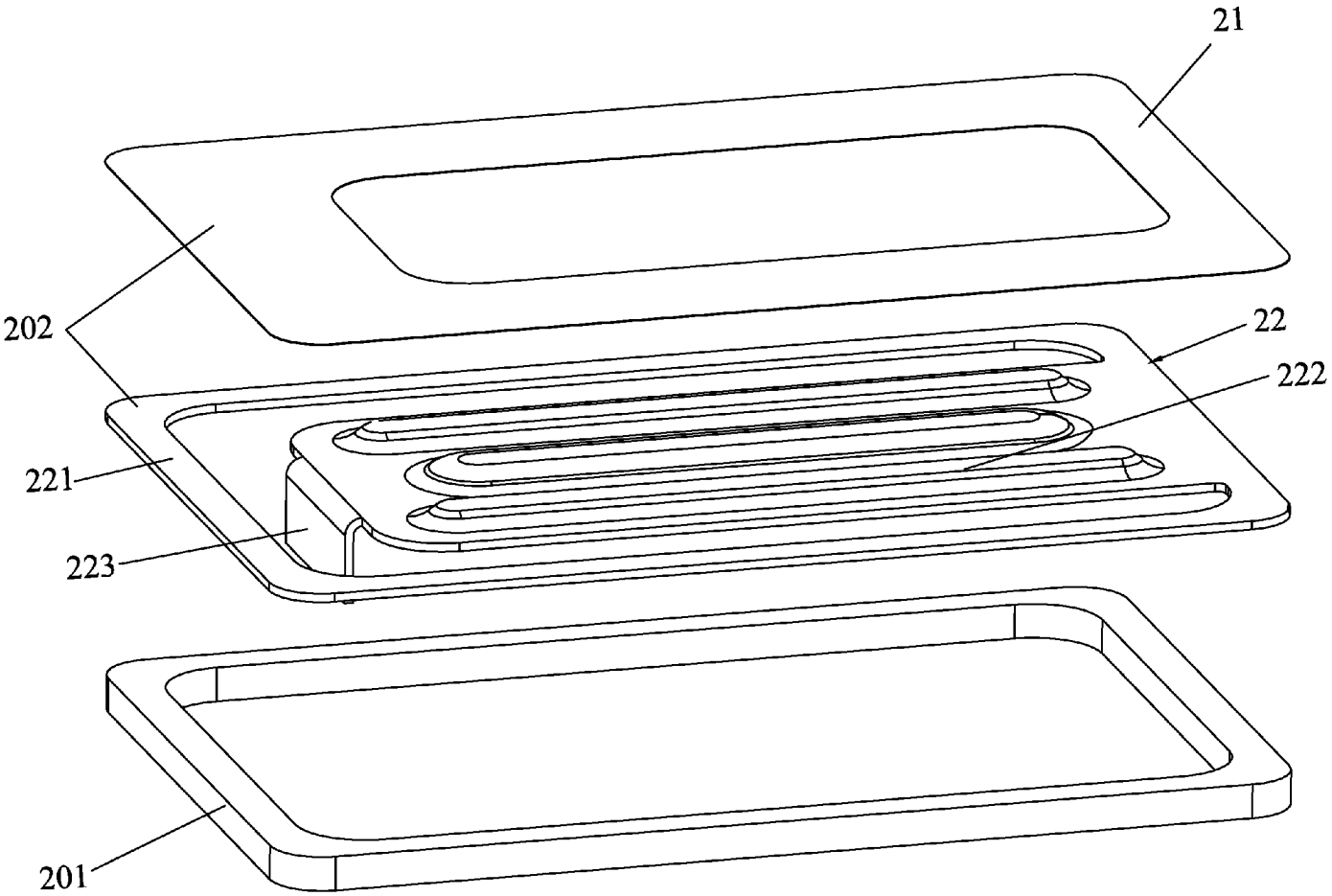
FIG. 9 shows another embodiment of the diaphragm sounding system of FIG. 8.

As shown in FIG. 9, there is no arc portion 225 between the vibration arm portion 222 and the dual-rectangle-shaped frame portion 221. The vibration arm portion 222 extends horizontally from the dual-rectangle-shaped frame portion 221. The metal sheet 22 is provided with three reinforcement ribs thereon. The reinforcement ribs are formed by pressing. The upper surfaces of the reinforcement ribs are formed with convex portions. The lower surfaces of the reinforcement ribs are formed with corresponding concave portions. The structure as shown in FIG. 8 and FIG. 9 can be applied to the first embodiment.

Figure 10:
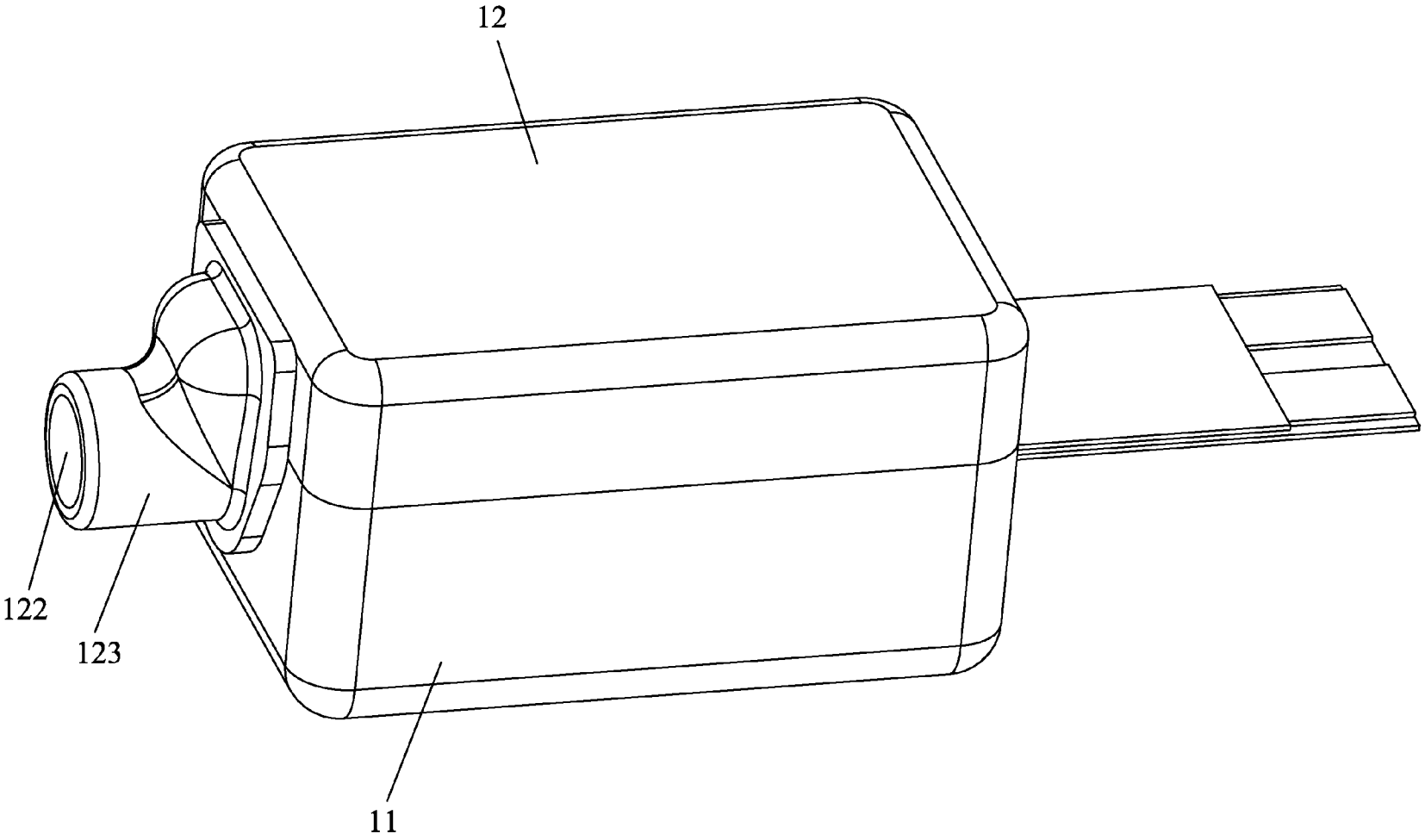
FIG. 10 shows another embodiment of the sound output hole of FIG. 1.

To compare FIG. 1 with FIG. 10, the sound output hole 121, as shown in FIG. 1, is disposed on the top of the cover 12. A sound output hole 122, as shown in FIG. 10, is disposed at a side of the cover 12, corresponding in position to the connecting arm 222. The side is provided with a sound guide cylinder 123 toward the sound output hole 122 for guiding the sound to output.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A moving iron sounding device, comprising a casing, a diaphragm sounding system, and a magnetic circuit system, the diaphragm sounding system and the magnetic circuit system being located in the casing; the magnetic circuit system comprising a dual-rectangle-shaped magnetic circuit, an inductance coil, and an armature, the armature having a vibration portion, the vibration portion passing through the inductance coil, a free end of the vibration portion being suspended in the dual-rectangle-shaped magnetic circuit; the diaphragm sounding system including a support ring and a composite diaphragm, the support ring having an opening, the composite diaphragm being disposed on top of the support ring to cover the opening of the support ring; the composite diaphragm including a diaphragm sheet and a metal sheet which are composited to become one-piece; a first end of the metal sheet being connected with the vibration portion, an interval being defined between the first end of the metal sheet and an inner wall surface of the opening of the support ring, a second end of the metal sheet being directly attached to the support ring, the metal sheet being connected with a connecting arm, a distal end of the connecting arm being provided with a welding portion, the welding portion being welded to the free end of the vibration portion;

wherein a distal end face of the second end of the metal sheet is attached to the inner wall surface of the support ring, an upper surface of the second end of the metal sheet is flush with an upper surface of the support ring; a circumferential edge of the diaphragm sheet extends out of the second end of the metal sheet to be attached to the upper surface of the support ring, or the distal end face the second end of the metal sheet is flush with a corresponding end face of the diaphragm sheet, and the second end of the metal sheet is directly attached to the upper surface of the support ring.

2. The moving iron sounding device as claimed in claim 1, wherein the inner wall surface of the support ring is further formed with a cavity, the cavity penetrates the upper and lower surfaces of the support ring, the distal end face of the second end of the metal sheet is attached to an inner wall surface of the cavity, an inner bottom portion of the cavity is provided with adhesive, the adhesive is disposed between a bottom face of the metal sheet and the inner wall surface of the cavity.

3. The moving iron sounding device as claimed in claim 1, wherein the metal sheet comprises a dual-rectangle-shaped frame portion and a vibration arm portion suspended in the dual-rectangle-shaped frame portion, one end of the dual-rectangle-shaped frame portion is integrally formed with an inner wall surface of the dual-rectangle-shaped frame portion, another end of the vibration arm portion is suspended and connected with the vibration portion, the diaphragm sheet corresponds in shape to the dual-rectangle-shaped frame portion, the diaphragm sheet is adhered to the dual-rectangle-shaped frame portion, and a raised arc portion is integrally formed between the vibration arm portion and the dual-rectangle-shaped frame portion.

4. The moving iron sounding device as claimed in claim 1, wherein the armature includes a substrate, two retaining walls, and the vibration portion, the vibration portion extends right from a right end of the substrate and then is bent reversely, the free end of the vibration portion extends left, two sides of the substrate are provided with side walls, and left ends of the side walls extend left to form the retaining walls, respectively.

5. The moving iron sounding device as claimed in claim 1, wherein the welding portion is integrally formed with the distal end of the connecting arm; or the extension arm and the connecting arm are formed separately and the welding portion is welded to the distal end of the connecting arm; the welding portion has a first welding face, an end face of the free end of the vibration portion is defined as a second welding face, the first welding face is attached to the second welding face; the welding portion is formed with a through groove for welding, the through groove penetrates the first welding face to another opposing face of the welding portion, the second welding face is exposed corresponding to the through groove; the through groove is located at one side or two sides of the welding portion; the through groove is formed with an opening at the side of the welding portion to penetrate an outside thereof, and the second welding face extends toward the outside of the opening and out of the opposing face of the welding portion.

* * * * *